US007074323B2

(12) United States Patent
Ghijsen

(10) Patent No.: US 7,074,323 B2
(45) Date of Patent: Jul. 11, 2006

(54) USE OF LOW PRESSURE DISTILLATE AS ABSORBER OIL IN A FCC RECOVERY SECTION

(75) Inventor: Pim Ghijsen, Amsterdam (NL)

(73) Assignee: Shell Oil Company, Houston, TX (US)

( * ) Notice: Subject to any disclaimer, the term of this patent is extended or adjusted under 35 U.S.C. 154(b) by 615 days.

(21) Appl. No.: 10/220,458

(22) PCT Filed: Mar. 2, 2001

(86) PCT No.: PCT/EP01/02452

§ 371 (c)(1),
(2), (4) Date: Aug. 29, 2002

(87) PCT Pub. No.: WO01/64818

PCT Pub. Date: Sep. 7, 2001

(65) Prior Publication Data

US 2003/0075485 A1 Apr. 24, 2003

(30) Foreign Application Priority Data

Mar. 3, 2000 (EP) ..... 00200768

(51) Int. Cl.
*C10G 5/04* (2006.01)
*C10G 5/06* (2006.01)
*C10G 11/00* (2006.01)

(52) U.S. Cl. ..... 208/101; 208/113; 208/341

(58) Field of Classification Search ..... 208/101, 208/341, 113
See application file for complete search history.

(56) References Cited

U.S. PATENT DOCUMENTS

| | | | | |
|---|---|---|---|---|
| 2,900,326 | A * | 8/1959 | Gilmore | 208/101 |
| 2,939,834 | A * | 6/1960 | Evans | 208/101 |
| 3,122,496 | A * | 2/1964 | Harper | 208/101 |
| 3,607,734 | A | 9/1971 | Stafford, Sr. | |
| 4,206,038 | A | 6/1980 | Smith et al. | |
| 4,431,529 | A | 2/1984 | Carson | |
| 4,605,493 | A | 8/1986 | Harandi | |
| 4,714,524 | A | 12/1987 | Harandi | |
| 4,831,203 | A | 5/1989 | Owen et al. | |
| 5,034,565 | A | 7/1991 | Harandi et al. | |
| 5,360,533 | A * | 11/1994 | Tagamolila et al. | 208/101 |
| 5,462,583 | A * | 10/1995 | Wood et al. | 95/192 |
| 5,520,724 | A * | 5/1996 | Bauer et al. | 95/169 |
| 6,576,805 | B1 * | 6/2003 | Keady et al. | 585/802 |

OTHER PUBLICATIONS

Fluid Catalytic Cracking Technology & Operations. Joseph W. Wilson. 1997. Pennwell Publishing Co. Tulsa. OK pp. 9-18 & 236-248.

* cited by examiner

*Primary Examiner*—Walter D. Griffin
(74) *Attorney, Agent, or Firm*—Charles W. Stewart

(57) ABSTRACT

A process for the recovery of gaseous products from the product mixture obtained by contacting a hydrocarbon feed with a catalyst in a fluid catalytic cracking process, wherein the liquid, obtained by separating the top product of main fractionators into gaseous and liquid fraction, when supplied to the absorber has a temperature of between about 8–25 DEG C. This liquid may be pre-saturated with gaseous top product from absorber; or also a high boiling fraction (cat cracker naphtha/light cycle oil) may be first separated from this liquid by distillation.

11 Claims, 3 Drawing Sheets

Fig 1, prior art

USE OF LOW PRESSURE DISTILLATE AS ABSORBER OIL IN A FCC RECOVERY SECTION

FIELD OF THE INVENTION

The invention relates to a process for the recovery of gaseous products from the product mixture obtained by contacting a hydrocarbon feed with a catalyst in a fluid catalytic cracking (FCC) process.

BACKGROUND OF THE INVENTION

Such a process is described in Fluid Catalytic Cracking Technology and Operations, Joseph W. Wilson, 1997, PennWell Publishing Company, Tulsa, Okla. USA, pages 9–18 and 236–248. According to this publication the FCC product mixture is first separated in a main fractionator by means of distillation. The gas from the main fractionator overhead drum flows to a wet gas compressor. This is usually a two-stage machine. The first stage discharge is cooled and partially condensed in an interstage cooler and the resulting liquid and gas fractions are subsequently separated in an interstage separator drum. The liquid obtained in this separator drum is combined with the liquid obtained after the second stage compression and fed to a stripper. In this stripper, or de-ethanizer tower ethane and lighter materials are removed from the liquid feed. The gaseous fraction obtained in the stripper is supplied to an absorber. To this absorber also the compressed gaseous fraction obtained after the second compression is supplied. In the absorber the more heavy compounds are removed by contacting the gaseous fraction with an absorber fluid, also referred to as absorber oil or lean oil. The bottom product obtained in the stripper is fed to a debutanizer. As absorber fluid overhead liquid from the main fractionator or debutanizer bottoms liquid are used. Typically the temperature of the fluid overhead liquid is between 40 and 50° C. Absorber overhead gas flows to the secondary or sponge absorber. The sponge absorber is intended to recover gasoline range material (mostly C5s) still present in the gas leaving the primary absorber. The rich oil obtained in the sponge absorber is recycled to the main fractionator. Because of this recycle of lower boiling hydrocarbons present in the rich oil to the main fractionator an increase of gas to be handled by the compressor will result.

U.S. Pat. No. 5,034,565 describes a process as described above, wherein primary absorber and stripper are combined in one vessel. U.S. Pat. No. 4,431,529, U.S. Pat. No. 4,714,524 and U.S. Pat. No. 4,605,493 describe a process as described above illustrating embodiments wherein stripper and absorber are arranged as separate process steps/vessels. In the above processes debutanizer bottoms are used as absorber fluid.

A problem often encountered with the above described processes is that the capacity of the main fractionator, compressor, primary absorber and/or stripper are not high enough when the charge of FCC product mixture is increased. In other words, these unit operations may form a bottleneck when the capacity of the FCC unit increases. An increase of FCC product mixture can for example be the resultant of better FCC catalyst used or a steady increase in FCC reactor capacity.

The present invention provides a method to debottleneck the above described process or to provide such a process which requires smaller equipment.

SUMMARY OF THE INVENTION

The above objectives is achieved with the following process. Process for the recovery of gaseous products from the product mixture obtained by contacting a hydrocarbon feed with a catalyst in a fluid catalytic cracking process, wherein the recovery comprises the following sequence of steps:

(a) separating the product mixture in a first distillation step in which a gaseous top product is obtained comprising products boiling below about 200° C., (b) cooling the gaseous top product of step (a) and separating the obtained liquid and gaseous fractions, (c) pressurizing the gaseous fraction obtained in step (b) in a compressor step, (d) cooling the pressurized product of step (c) and separating the obtained liquid and gaseous fractions, (e) supplying the gaseous fraction obtained in step (d) to an absorber in which absorber the gaseous fraction is contacted with the liquid fraction obtained in step (b) thereby obtaining a lower boiling fraction rich in gaseous products having a boiling point of ethane or below and a contacted liquid absorber oil fraction, (f) supplying the liquid fraction obtained in step (d) together with the contacted liquid absorber oil fraction obtained in step (e) to a stripper and obtaining a liquid fraction rich in hydrocarbons having a boiling point higher than ethane and a gaseous fraction, (g) supplying the gaseous fraction obtained in step (f) to step (d) or step (e), (h) supplying the liquid fraction obtained in step (f) to a debutanizer distillation step wherein a fraction comprising butane and lower boiling compounds and a higher boiling fraction is obtained.

Wherein the liquid fraction obtained in step (b) has a temperature of between from about 8 to about 25° C.

It has been found that the recovery of $C_3$–$C_5$ hydrocarbons in step (e) of the process according to the invention is sufficiently high that no sponge absorber (secondary absorber) is needed. Because no sponge absorber is present no recycle of rich oil from this sponge absorber to the main fractionator will take place. Thus the throughput of main fractionator, compressor and stripper/absorber is increased. For an existing process a simple method of debottlenecking is provided for. For new processes according to the invention smaller apparatuses can be used when compared to state of the art processes having the same capacity. A further advantage is that by eliminating the sponge absorber less equipment is needed as compared to the state of the art processes. More advantages of the present invention will be described below.

BRIEF DESCRIPTION OF DRAWINGS

The invention shall be illustrated by making use of FIGS. 1–3.

DETAILED DESCRIPTION OF THE INVENTION

Figure 1:
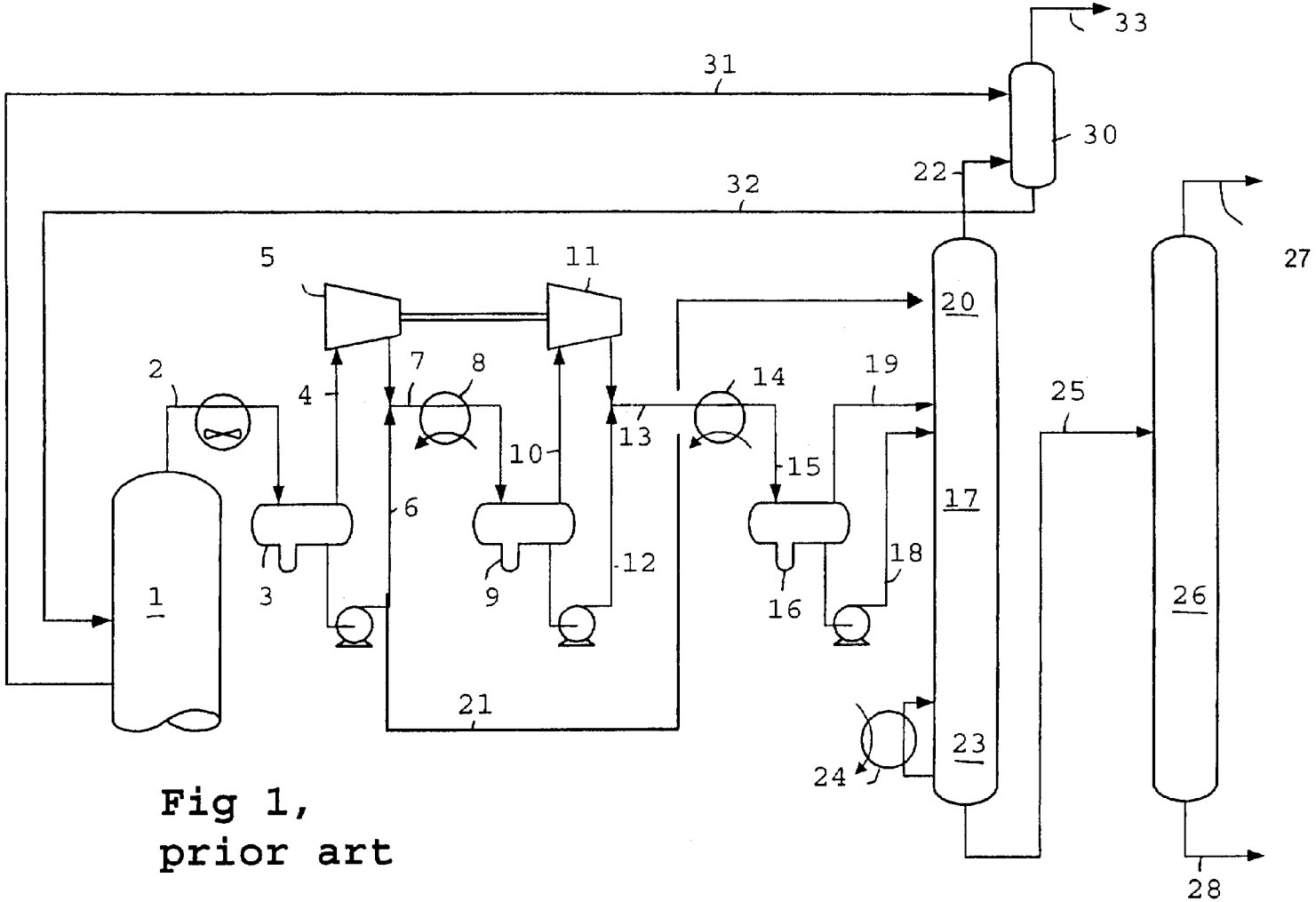
FIG. 1 illustrates a state of the art process.

FIG. 1 illustrates a state of the art process for the recovery of gaseous products from the product mixture obtained by contacting a hydrocarbon feed with a catalyst in a fluid catalytic cracking process. FIG. 1 shows the top part of a first distillation column 1, also referred to as main fractionator, a gas conduit 2, a main fractionator overhead drum 3 from which a gas conduit 4 supplies a gaseous product to a first compressor step 5. Part or all of the liquid fraction obtained in separator 3 is supplied via conduit 21 to absorber section 20. The compressed gaseous fraction obtained in compressor 5 is optionally combined with the remaining part of the liquid fraction via 6 obtained in the overhead drum 3 in conduit 7 and cooled in heat exchanger 8. The cooled gas-liquid fraction is separated in liquid and gaseous fractions in separator 9. The gaseous fraction is supplied via 10 to a second compressor step 11. The liquid fraction via conduit 12 is combined with the compressed gaseous fraction ex compressor 11 in conduit 13. The combined fractions are subsequently cooled by heat exchanger 14 and the cooled gas-liquid mixture is supplied via conduit 15 to separator 16.

In separator 16 a liquid and gaseous fraction is obtained and fed to a combined stripper-absorber column 17 via respectively conduits 18 and 19. The liquid fraction via conduit 18 is supplied at a lower position in column 17 than the gaseous fraction via conduit 19. The upper part of the absorber/stripper column 17 is the absorber section 20 in which the gaseous fraction is contacted with the liquid fraction obtained in separator 3. This liquid fraction is supplied via conduit 21 to the top of the absorber section 20. At this top a lower boiling fraction rich in gaseous products having a boiling point of ethane or below is obtained via conduit 22.

The lower section of column 17 is the stripper section 23, wherein the liquid fraction supplied via conduit 18 and the contacted liquid absorber oil fraction from absorber section 20 is stripped by the gaseous fraction obtained in reboiler 24. Via conduit 25 a liquid fraction comprising propene and hydrocarbons having a boiling point higher than ethane is discharged from the stripper bottom section. The gaseous fraction moving upwards in the stripper section 23 is supplied to absorber section 20 in column 17. When absorber and stripper are arranged in separate vessels it may be advantageous to supply the gaseous fraction discharged from the stripper to heat exchanger 14 and separator 16 before the fraction is supplied to the absorber. Such a line up is exemplified in U.S. Pat. No. 4,714,524.

The liquid fraction obtained in the stripper section 23 is supplied to a debutanizer distillation column 26 wherein a fraction comprising butane and lower boiling compounds is discharged via conduit 27 and a higher boiling fraction is discharged via conduit 28.

The gaseous fraction obtained in the absorber section 20 is supplied via conduit 22 to a sponge or secondary absorber 30. In this sponge absorber 30 the gaseous fraction is contacted with a side stream of the main fractionator 1, supplied to the sponge absorber 30 via conduit 31. The liquid discharge of the sponge absorber 30 is recycled to the man fractionator 1 via return conduit 32. Via conduit 33 a gaseous fraction rich in compounds having a boiling point of ethane or below is obtained.

Figure 2:
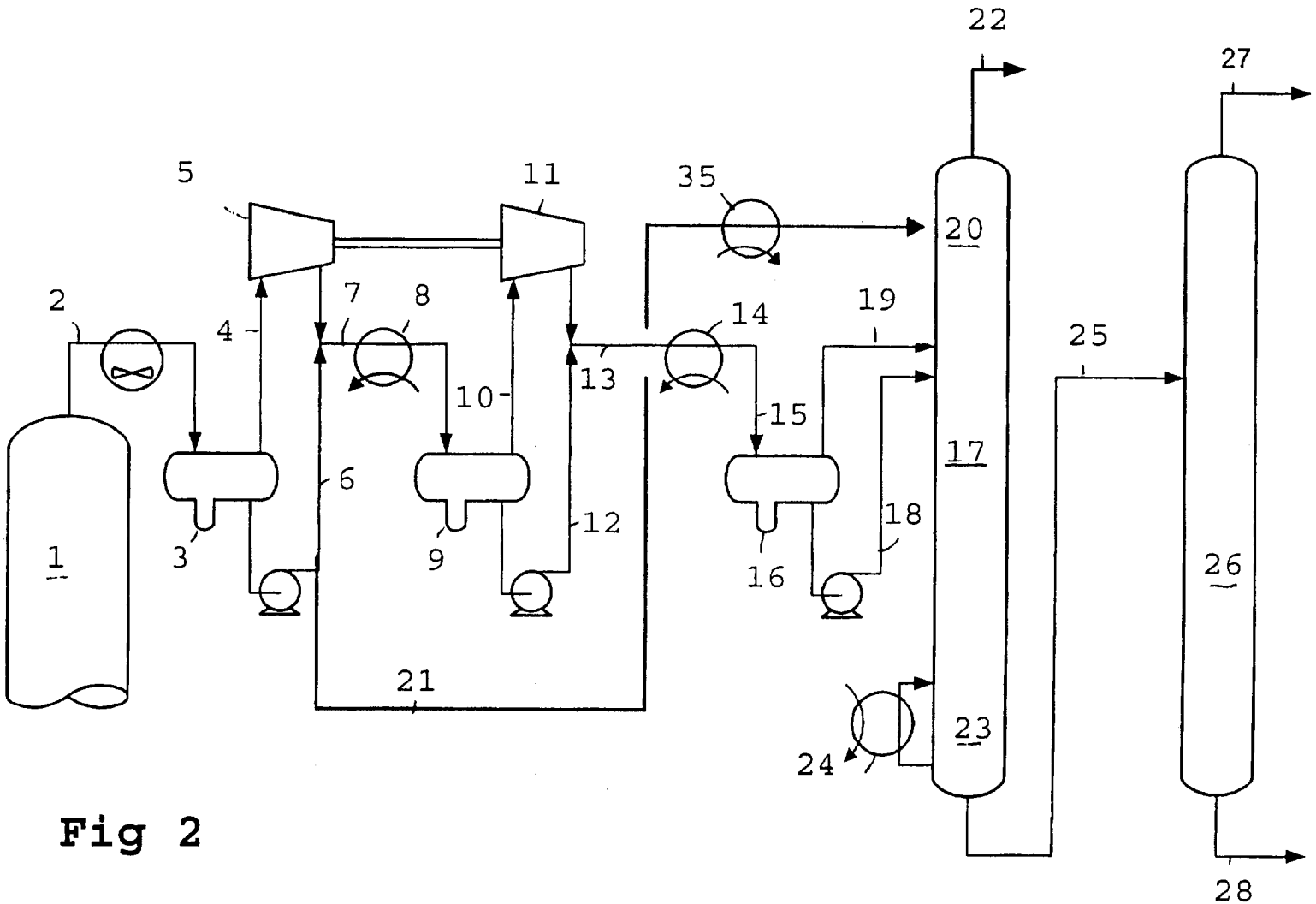
FIG. 2 illustrates a process according to the invention.

FIG. 2 illustrates the process according to the invention wherein the liquid fraction obtained in separator 3 is reduced in temperature in heat exchanger 35 before being supplied to absorber section 20. The temperature of this liquid fraction is preferably between from about 12 to about 20° C. For an optimal recovery of for example propylene in the absorber section 20 the temperature of the absorber fluid is preferably as low as possible. The minimum temperature is determined by the, to be avoided, formation of hydrates at lower temperatures. Hydrates are crystal like deposits comprising light hydrocarbons and water and/or $H_2S$. The minimum temperature will depend on the actual contents of these components in the fraction to be cooled. Preferably the skin temperature of the heat exchanger surface is at least about 5° C. greater than the hydrate formation temperature. Cooling can be suitably performed using chilled water as an indirect cooling medium. Because of the resulting lower temperature of the absorber fluid supplied via conduit 21 a lower temperature profile in the absorber section 20 results. A further improvement in absorber capacity can be suitably achieved by making use of a side cooler, wherein part of the content of the absorber section 20 at an intermediate position in said section is externally cooled and returned to the absorber section (not shown). Due to this lower temperature profile even less $C_3$–$C_5$ hydrocarbons and especially propylene will leave the primary absorber section 20 via conduit 22. The meanings of the other references are the same as in FIG. 1.

An even more preferred embodiment (not shown) of the process illustrated in FIG. 21 is wherein the liquid fraction supplied via conduit 21 is first mixed with the gaseous fraction leaving the absorber section 20 via conduit 22 before being cooled. Subsequently this mixture is cooled to a temperature between from about 8 to about 25° C. and preferably between from about 12 to about 20° C. and separated in a liquid and gaseous fraction. The liquid fraction is subsequently supplied to the top of the absorber section 20 as absorber oil. The advantage of such a pre-saturation step is an even better recovery $C_3$–$C_5$ compounds.

Preferably part of the mixture in conduit 21 is directly supplied to the debutanizer 26. The advantage of this embodiment is a further capacity increase of the absorber/stripper sections. It has been found that part of the mixture of conduit 21 can by-pass the absorber/stripper 17 without a significant amount of $C_2$-minus compounds being supplied to the debutanizer 26.

Figure 3:
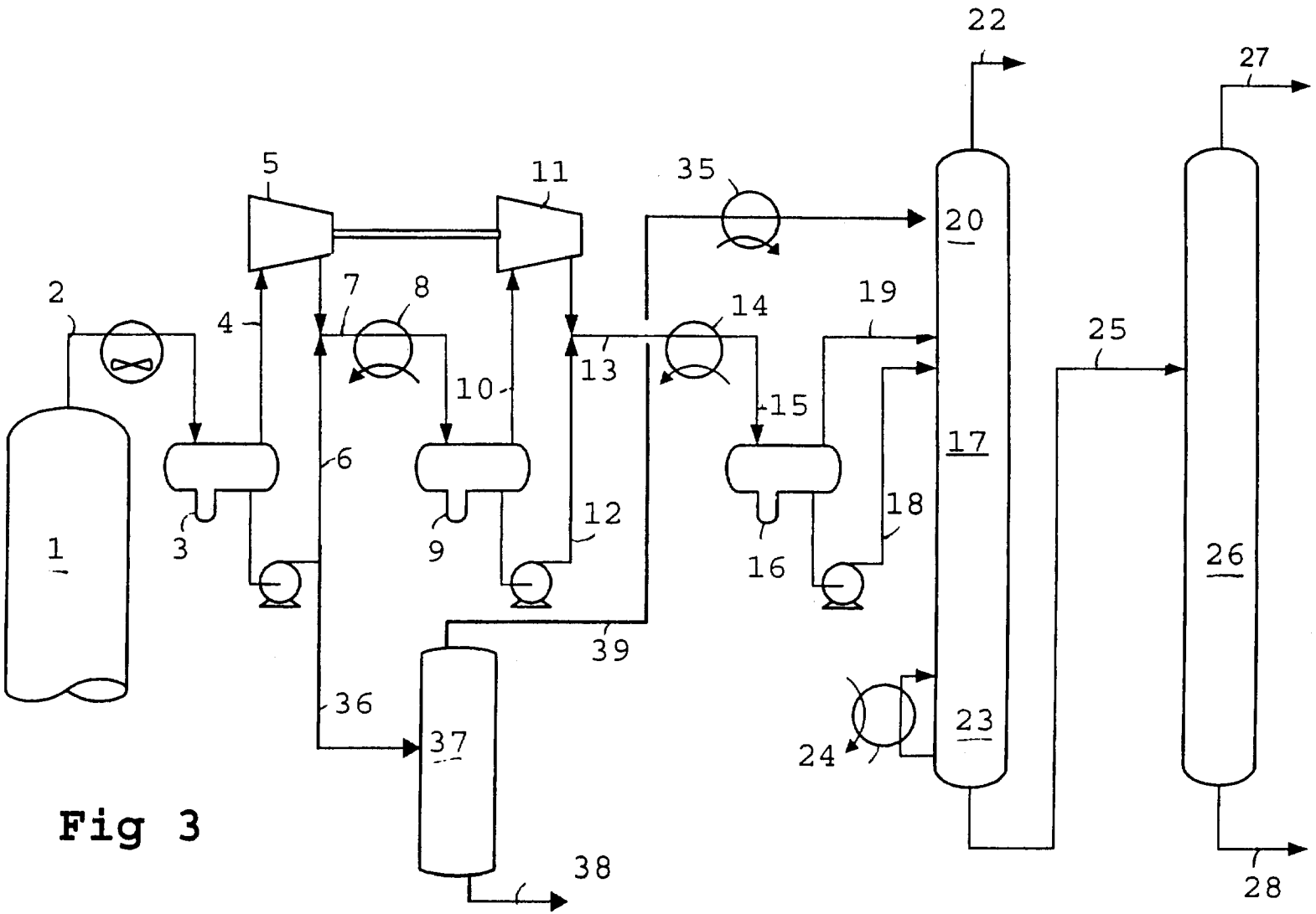
FIG. 3 illustrates a process according to the invention wherein first a heavy fraction is removed from the liquid fraction obtained in step (b) before using this fraction as an absorber oil fraction in step (e).

FIG. 3 illustrates another preferred embodiment of the invention, wherein a high boiling fraction is first separated from the liquid fraction obtained in separator 3 before supplying this fraction to absorber section 20. This high boiling fraction initial boiling point of between from about 100 to about 160° C. This high boiling fraction will comprise what is typically referred to as cat cracker naphtha and light cycle oil. This sequence of steps even further reduced the throughput of the absorber/stripper sections 20, 23 and debutanizer 26 as compared to the above described processes. A further advantage is that a product referred to as cat cracker tops, comprising mainly a hydrocarbon fraction having a final boiling point of between from about 10 to about 160° C., is directly obtained as the bottom product of the debutanizer 26. Via conduit 36 the liquid fraction obtained in separator 3 is supplied to distillation column 37 in which the higher boiling fraction is discharged via conduit 38. The lower boiling fraction is condensed and cooled to the desired temperature before being supplied via conduit 39 to absorber section 20.

The invention is also directed to a method to retrofit existing processes to a process according to the invention. It has been found that relatively simple adjustments to an existing plant can result in a considerably capacity increase without the necessity to replace existing compressors, debutanizer columns and/or absorber and stripper vessels. For example, existing processes which use debutanizer bottoms as lean oil in the absorber will improve also their debutanizer capacity by adjusting to the process according to the invention. Existing processes which use their overhead liquid from the main fractionator as lean oil in the absorber can be simplified and increased in capacity by adding additional chilling means and so arriving at the process according to the invention.

The invention claimed is:

1. A process for the recovery of gaseous products from a product mixture obtained by contacting a hydrocarbon feed with a catalyst in a fluid catalytic cracking process, wherein the recovery comprises; the following sequence of steps:

(a) separating the product mixture in a first distillation step in which a gaseous top product is obtained comprising products boiling below about 200° C.;

(b) cooling the gaseous top product of step (a) to obtain a first liquid and gaseous fractions and separating said first liquid and gaseous fractions to provide a first liquid fraction and a first gaseous fraction;

(c) pressurizing the first gaseous fraction obtained in step (b) in a compressor step to obtain a pressurized product;

(d) cooling the pressurized product of step (c) and to obtain a second liquid and gaseous fractions and separating said second liquid and gaseous fractions to provide a second liquid fraction and a second gaseous fraction;

(e) supplying the second gaseous fraction obtained in step (d) to an absorber section of a stripper-absorber column in which the second gaseous fraction is contacted with the first liquid fraction obtained in step (b) to thereby provide for yielding from said stripper-absorber column a lower boiling fraction rich in gaseous products having a boiling point of ethane or below;

(f) supplying the second liquid fraction obtained in step (d) to a stripper section of said stripper-absorber column which provides for yielding from said stripper-absorber column a liquid fraction rich in hydrocarbons having a boiling point higher than ethane; and, (g) supplying the liquid fraction rich in hydrocarbons having a boiling point higher than ethane obtained in step (f) to a debutanizer distillation step whereby a light fraction comprising butane and lower boiling compounds and a higher boiling fraction are obtained, wherein the first liquid fraction obtained in step (b) has a temperature of between from about 8° C. to about 25° C. when supplied to the absorber section in step (e).

2. The process according to claim 1, wherein the first liquid fraction obtained in step (b) has a temperature of between from about 12° C. to about 20° C. when supplied to the absorber section in step (e).

3. The process according to claim 2, wherein a heavy boiling fraction is first separated from the first liquid fraction obtained in step (b) before using this fraction in step (e).

4. The process according to claim 2, wherein the content of the absorber section in step (e) is cooled by making use of a side cooler.

5. The process according to claim 2, wherein part of the first liquid fraction obtained in step (b) is directly supplied to the debutanizer distillation step (g).

6. The process of claim 5, wherein the content of the absorber section in step (e) is cooled by making use of a side cooler.

7. The process according to claim 1, wherein a heavy boiling fraction is first separated from the first liquid fraction obtained in step (b) before using this fraction in step (e).

8. The process according to claim 7, wherein the initial boiling point of the heavy boiling fraction has an initial boiling point of between from about 100° C. to about 160° C.

9. The process of claim 7, wherein part of the first liquid fraction obtained in step (b) is directly supplied to the debutanizer distillation step (g).

10. The process according to claim 1, wherein the content of the absorber section in step (e) is cooled by making use of a side cooler.

11. The process according to claim 1, wherein part of the first liquid fraction obtained in step (b) is directly supplied to the debutanizer distillation step (g).

* * * * *